US005839305A

United States Patent [19]

Aston

[11] Patent Number: 5,839,305

[45] Date of Patent: Nov. 24, 1998

[54] ELECTRICALLY OPERABLE CYLINDER LOCK

[75] Inventor: Walter John Aston, Sedgeley, England

[73] Assignee: Yale Security Products Limited, West Midlands, England

[21] Appl. No.: 793,631

[22] PCT Filed: Sep. 4, 1995

[86] PCT No.: PCT/GB95/02081

§ 371 Date: May 6, 1997

§ 102(e) Date: May 6, 1997

[87] PCT Pub. No.: WO96/07807

PCT Pub. Date: Mar. 14, 1996

[30] Foreign Application Priority Data

Sep. 3, 1994 [GB] United Kingdom ..... 9417748

[51] Int. Cl.[6] ..... E05B 49/00

[52] U.S. Cl. ..... 70/278; 70/282; 70/496; 70/283; 70/375

[58] Field of Search ..... 70/277, 276, 278, 70/283, 282, 375, 490, 495, 496

[56] References Cited

U.S. PATENT DOCUMENTS

| | | | |
|---|---|---|---|
| 3,889,501 | 6/1975 | Fort | 70/283 |
| 4,712,398 | 12/1987 | Clarkson et al. | 70/283 |
| 4,807,454 | 2/1989 | Sengupta et al. | 70/277 |
| 4,827,744 | 5/1989 | Namazue et al. | 70/282 |
| 5,010,750 | 4/1991 | Böser et al. | 70/276 |
| 5,351,042 | 9/1994 | Aston | 70/278 |
| 5,561,997 | 10/1996 | Milman | 70/277 |
| 5,699,686 | 12/1997 | Neumayer et al. | 71/283 |

FOREIGN PATENT DOCUMENTS

| | | |
|---|---|---|
| A-0452298 | 10/1961 | European Pat. Off. . |
| A-0303849 | 2/1989 | European Pat. Off. . |
| A-0462316 | 12/1991 | European Pat. Off. . |
| WO 93/19267 | 3/1993 | Sweden . |

*Primary Examiner*—Darnell M. Boucher

[57] ABSTRACT

An electrically operable cylinder lock device includes a body with a bore housing a rotatable barrel, having a key slot. The barrel is locked in position normally by a spring-loaded bar which extends axially of the barrel and is movable radially thereof. A slot in the barrel receives the bar and cam formations in the slot act to lift the bar to a withdrawn position in which it can be held by an electro-magnet. A plunger in the bore has a slotted end to receive the tip of the key and provides a driving connection between the key and an output cam.

11 Claims, 5 Drawing Sheets

ELECTRICALLY OPERABLE CYLINDER LOCK

This invention relates to an electrically operable cylinder lock.

It has long been considered desirable to provide an electrically operable cylinder lock which is fully self contained and which is such a size and shape that it can be substituted for an ordinary cylinder lock, but this goal has proved elusive for several reasons.

One problem which arises is that of ensuring that the electrical energy required to operate the lock is minimised. We have previously proposed energy saving locking devices using an electromagnet to restrain movement of a detent element. With this arrangement the detent element coacts with a movable part of the lock so that when the movable part is in a normal rest position the air gap between the detent element and the electromagnet one is minimised so that only a relatively low current is required to restrain the detent from moving into a locking position as the movable part is turned out of its normal rest position. The inclusion of such an arrangement in an electrically operated cylinder lock poses problems because of the confined space available and because it must be resistant to so-called "rapping"—a lock opening technique in which torque is applied to the movable part of the lock whilst the body of the lock is tapped repeatedly to make any spring-loaded detents in the lock jump out of their locking positions.

A lock device in accordance with one aspect of the present invention comprises a body having a bore, a rotatable barrel in said bore, said barrel being provided with an axially extending locking slot formation, an axially extending bar slidably mounted in the body for radial movement relative to the barrel between a detent position in which the bar projects into the locking slot formation to limit turning of the barrel and a release position in which the bar is clear of said lock slot formation, a cam formation on said barrel for displacing the bar from its detent position and its release position as the barrel is turned in the body and an electromagnet energisable to retain said bar by magnetic attraction in its release position.

Preferably, the cam formation on said barrel comprises two separate cam portions at opposite ends of said locking slot, acting on portions of the bar at opposite ends thereof. In this case, the bar is preferably urged towards the barrel by two independent springs acting on opposite ends of the bar.

Alternatively, the cam formation on the barrel may be of constant cross-sectional shape, spaced cam-engaging portions being provided at opposite ends of the bar.

The cam formation on said barrel may have a single peak profile so as to locate the bar in its release position when the barrel is in a normal rest position, but preferably the cam formation has a twin peak profile such that in a normal rest position the bar is in its detent position, but is displaced to its release position by initial turning of the barrel out of the normal rest position. In this case, the spring loading of the bar can be used to locate the barrel in its rest position. This arrangement also makes it significantly more difficult to release the lock by so-called "rapping".

Preferably, the electromagnet is mounted in the body so as to be freely movable radially relative to the barrel and the cam formation on the barrel is dimensioned so as to ensure that the bar makes actual physical contact with the electromagnet and displaces it radially outwardly as the bar is moved to its release position.

The electromagnet may be housed in a carrier which has a slot in which the bar is slidable and location means for springs which act on the bar. The carrier with the electromagnet, bar and springs pre-assembled with it, can be inserted into an opening in the body during assembly of the lock. When the electromagnet is free to move axially as described above, such freedom is provided by allowing free movement of the electromagnet within the carrier.

Another problem which arises is that there is a need in an electrically operated lock to provide some sort of switch to energise the lock circuits only when a key is inserted. Previous proposals have used the key itself as a switch contact and this has been found to be unsatisfactory for several reasons. Other proposals have used specially shaped switch contacts which are engaged by the key, but these too have proved to be somewhat unreliable.

In accordance with another aspect of the invention, there is provided an electrically operable cylinder lock device comprising a lock body having a longitudinal bore, a barrel rotatably mounted in said bore at one end of the body, said barrel having a key-receiving slot, electrical means for recognising an authorised key inserted in said key slot and for allowing turning of the barrel only when such a key is recognised, a slidable member mounted in said bore, which is displaceable axially in said bore by a key inserted in the key slot and a microswitch mounted in a chamber in said body and having an actuating element projecting into the bore in the path of said slidable member, said microswitch controlling the supply of electrical power to said electrical means.

It will be noted that a conventional microswitch is used in the structure defined above. As distinct from a specially constructed contact or other detecting element, a conventional microswitch is capable of surviving many millions of operations and is very inexpensive to obtain and install.

In accordance with yet another aspect of the invention there is provided an electrically operable cylinder lock device comprising a lock body having a longitudinal bore, a barrel rotatably mounted in said bore at one end of the body, said barrel having a key-receiving slot, electrical means for recognising an authorised key inserted in said key slot and for allowing turning of the barrel only when such a key is recognised, a manually operable knob rotatably mounted at the opposite end of the body, and a plunger mounted in the bore in the body, said plunger being drivingly coupled to said knob and to a lock output member, and said plunger having a slot therein arranged to receive the end of a key inserted into said key-slot in the barrel to provide a drive connection between the key and the plunger.

Yet another problem is that an electrically operable lock requires a source of electrical power which is usually a battery. With previously suggested designs it has not been found possible to fit one or more batteries large enough to provide an adequate capacity into the narrow confines of a conventional cylinder lock body shape. To overcome this problem previous proposals have used a separate container housed either in a specially designed escutcheon or in a separate hole in the door. In either case it has been necessary to provide wiring for connecting the battery or batteries to the electrical circuits of the lock. Thus the aim of making the lock truly self-contained has not been met.

According to yet another feature of the present invention there is provided an electrically operable cylinder lock device comprising a lock body having a longitudinal bore therein which is offset from a median line of the body, a rotatable barrel mounted in said bore at one end of the body, said barrel having a key-receiving slot, electrical means for recognising an authorised key inserted in said key slot and for allowing turning of said barrel only when such key is recognised, a hollow knob mounted on and surrounding the other end of the body for rotation about said median line of the body, drive means connecting said knob to a drive element rotatably contained in said bore, and at least one battery mounted on the body inside said knob and connected to said electrical means.

Figure 1:
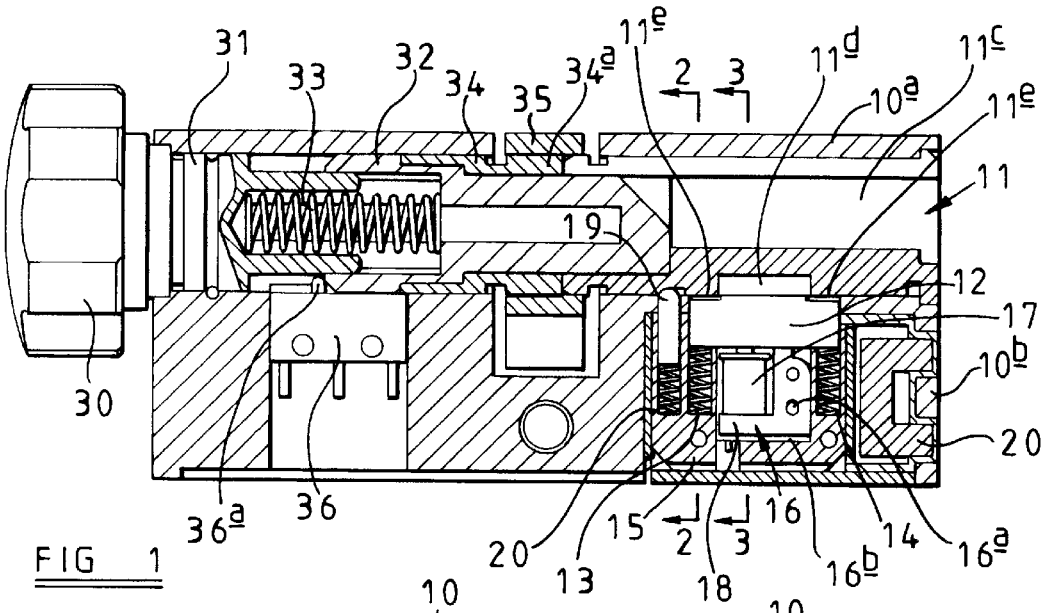
FIG. 1 is a longitudinal section through one example of an electrically operable cylinder lock in accordance with the invention.
Figure 2:
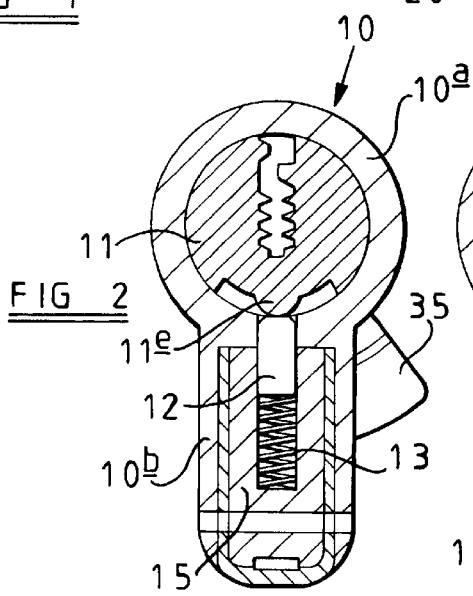
FIG. 2 is a section of the lock on line 2—2 in FIG. 1.
Figure 3:
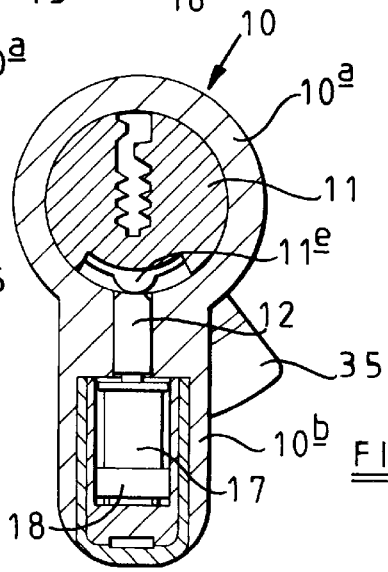
FIG. 3 is a section on line 3—3 in FIG. 1.
Figure 4:
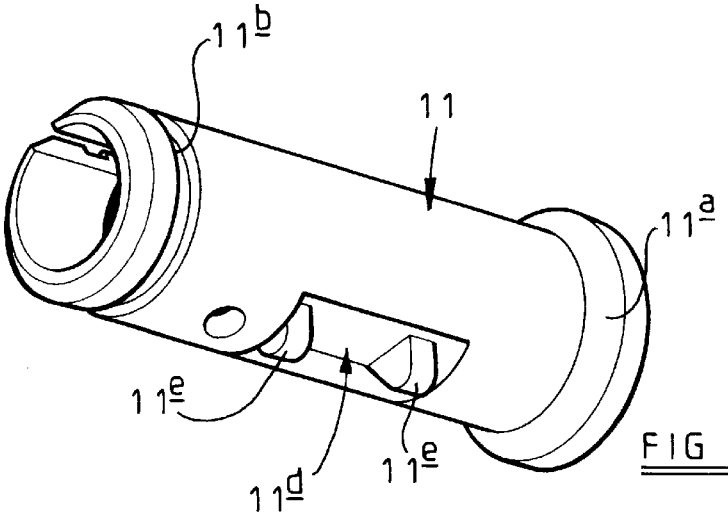
FIG. 4 is a perspective view of a barrel forming part of the lock.

Referring firstly to the embodiment of the invention shown in FIGS. 1 to 5, the lock has a cylindrical body 10 of a standard shape which comprises a circular cylindrical portion $\mathbf{10}^a$ which houses the barrel 11 of the lock and a flat part $\mathbf{10}^b$, of thickness less than the diameter of the circular cylindrical portion $\mathbf{10}^a$. The body thus has a cross-sectional shaped similarly to a conventional keyhole shape. In a mechanical pin-tumbler type cylinder lock the bores housing the pin-tumbler combinations would be in the flat part $^{10b}$.

The barrel 11 is mounted in one end of an axial bore in the circular cylindrical portion $\mathbf{10}^a$ of the body. It has an enlarged flanged $\mathbf{11}^a$ at one end and a groove $\mathbf{11}^b$ adjacent the other and is retained in position by a circlip (not shown) engaged in this groove $\mathbf{11}^b$. The barrel has a broached key slot $\mathbf{11}^c$ like the barrel of a normal mechanical lock, the cross-section of this slot determining the profile of the matching key to be used with the lock.

FIGS. 1 to 4 show an electromagnetically actuable detent arrangement for locking the barrel 11 in position except when correctly released. The detent is in the form of an elongated axially extending bar 12 which coacts with a formation $\mathbf{11}^d$ machined in the cylindrical surface of the barrel. The formation comprises an axially extending groove in the surface of the barrel. At each end of this groove there is a centrally placed raised projection $\mathbf{11}^e$ the radially outermost part of which is substantially flush with the cylindrical surface of the barrel 11. The two ends of the bar 12 are acted upon by two spaced independent springs 13, 14 which urge the bar 12 radially towards the axis of the barrel. The bar 12 is mounted for radial sliding movement in a slot in the flat part $\mathbf{10}^b$ of the body and the formation $\mathbf{11}^d$ is located on the barrel 11 such that when the barrel is in a normal rest position the ends of the bar 12 press against the two projections $\mathbf{11}^e$. If the barrel is turned in either direction out of this normal rest position the spring loading on the bar causes it to move radially towards the axis of the barrel to a locking position such that it prevents further turning of the barrel. Thus the barrel is permitted only a small angular movement out of its normal rest position unless some action is taken to prevent movement of the bar 12 to its locking position.

To allow opening of the lock, an electromagnet 16 is provided in a carrier 15. This carrier 15 is fitted into a chamber formed in the flat part $\mathbf{10}^b$ of the body and has bores to contain the springs 13 and 14. The electromagnet has a winding 17 on one limb of a U-shaped core the ends of the limbs of which abut the bar 12. When the winding 17 is energised, the bar 12 is held back against the force of the springs 13 and 14 and does not move when the barrel is turned in either direction from its rest position. Hence the barrel remains free to turn.

The carrier 15 also has a further bore parallel to those holding the springs 13 and 14. The further bore contains a slidably mounted locating pin 19 having a bevelled end and a spring 20 urging the pin 19 towards the barrel which has a notch formed to receive the bevelled end of pin 19. This pin/notch arrangement acts to hold the barrel lightly in the rest position referred to above.

Figure 5:
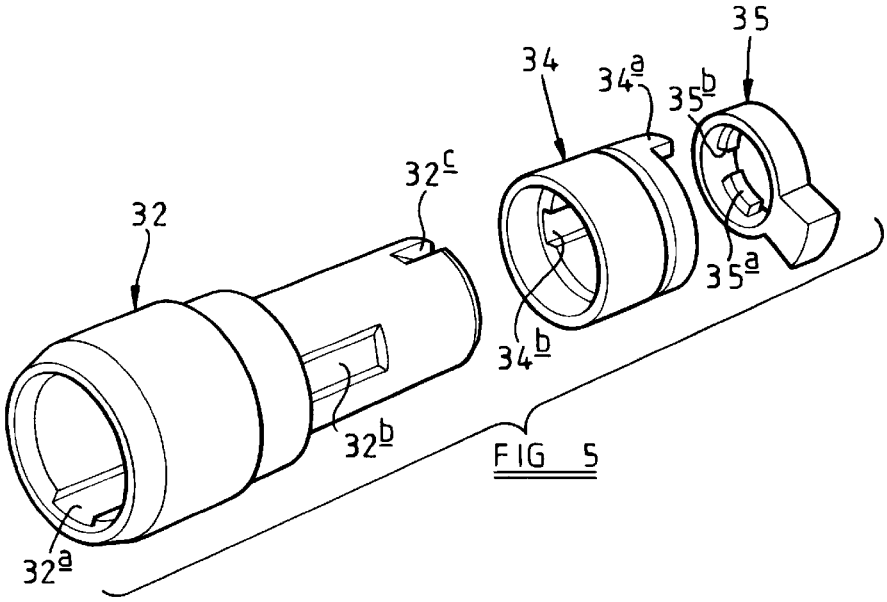
FIG. 5 is an exploded perspective view of a plunger, a cam drive member and an output cam forming part of the lock.

The chamber in the flat part $\mathbf{10}^b$ of the body which contains the electromagnet 16 and its carrier 15, also houses a C-core 20 which is used by a system for transferring electrical energy and electrical signals between the lock and a key which is used in conjunction therewith (see FIG. 5). The key has a corresponding core installed in its grip portion and when the key blade is inserted into the key slot in the barrel and the latter is in its normal rest position the two C-cores are aligned to form a complete core. Windings on these cores are magnetically coupled thereby. The key normally contains no battery and the cores are used when the key is first inserted, to transfer electrical energy stored in a lock battery to a capacitor in the key to provide power for electronic circuits in the key. Such circuits produce a stream of digital electrical signals which are transmitted to electronic circuits in the lock via the cores. However, there may also be provided an emergency key which does contain batteries which can be used to provide power to the lock electronics if the lock battery has failed whilst the user is locked out.

In the arrangement shown in FIG. 1, the lock body has the key barrel 11 at one end thereof for operating the lock from outside the door it is mounted on. At the other end it has a simple knob 30 for opening the door from inside when required.

This knob 30 has a boss 31 which is rotatably mounted in the bore in the circular cylindrical portion $\mathbf{10}^a$ of the body. The boss has two projecting prongs which are received in internal grooves $\mathbf{32}^a$ in a bore in a plunger 32 which is mounted in the bore in the body for rotary and axial sliding movement. A spring 33 is compressed between the knob 30 and the plunger 32 to urge the latter towards the barrel 11. FIG. 1 shows the relative positions of the parts of the lock when no key is inserted and it will be noted that the end of the plunger 32 is received in a bore in the end of the barrel 11.

The plunger 32 extends through a cam drive member 34 which is of the same external diameter as the barrel 11. An output cam 35 surrounds the adjacent ends of the barrel 11 and the cam drive member 34. The cam drive member 35 has an internal flange $\mathbf{35}^a$ which is formed with slots with which dogs $\mathbf{34}^a$ on cam drive member 34 are engaged to provide a driving connection between the cam drive member 34 and the output cam 35.

The cam drive member 34 has internal grooves which receive driving ribs $\mathbf{32}^b$ on the plunger $\mathbf{32}^b$. A driving connection between the plunger 32 and the cam driver member 34 is thus provided, but there is no driving connection, in the absence of the key, between the barrel 11, the plunger 32, the cam drive member 34 or the output cam 35. Thus, in the condition shown in FIG. 1, the output cam can be turned as required by the knob 30 even though the barrel 11 cannot be turned more than a few degrees in either direction from its normal rest position.

It will be noted, however, that the end of the plunger 32 adjacent the barrel 11 is formed with a slot 32$^c$ which is aligned with the key slot when all the parts of the lock are arranged in their normal rest positions as shown in FIG. 1. The arrangement of slot 32$^c$ is such that the ends of any key inserted into the key slot will enter the slot 32$^c$ and thereby provide a driving connection between the barrel 11 and the plunger 32. Since the plunger 32 is drivingly connected to the output cam 35, turning of the key will cause turning of the output cam if the key is one which is recognised by the lock electronic circuits which energise the winding 17.

The plunger 32 also forms part of an arrangement for detecting the pressure of a key inserted in the key way in the barrel to provide power to the lock electronic circuits. As mentioned above, the plunger 32 is axially slidable in the bore in the body 10. The length of the blade of the key used with the lock is such that full insertion of the key into the keyslot causes the plunger 32 to be displaced against its spring loading. The plunger coacts with a conventional microswitch 36 mounted in a chamber in the flat part 10$^b$ of the body. As will be seen in FIG. 1, the actuating element 36$^a$ of the microswitch 36 projects into the bore in the body in the path of the end of the plunger 32.

The microswitch 36 serves to control the electrical connection of the lock electronic circuits to the lock battery which, in the example of FIG. 1, is not shown as it is housed elsewhere.

Figure 6:
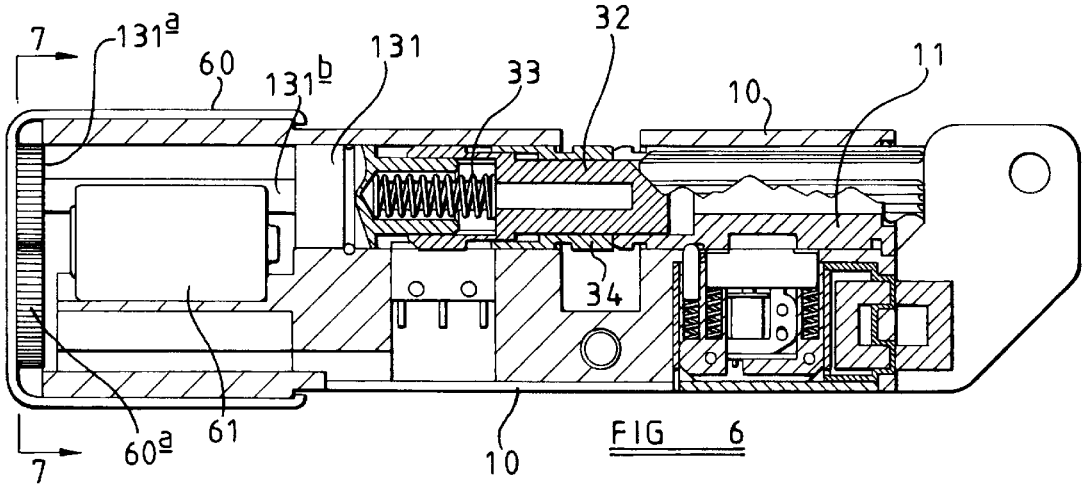
FIG. 6 is a longitudinal section showing a second embodiment of the invention.
Figure 7:
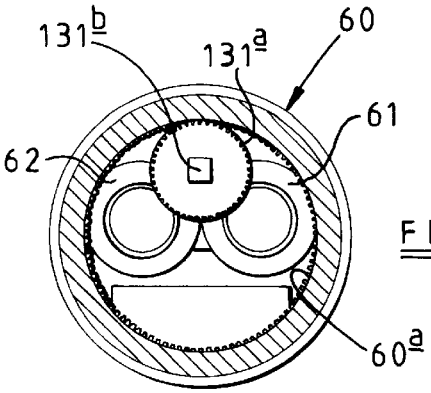
FIG. 7 is a section on line 7—7 in FIG. 6.

In the example of the invention shown in FIGS. 6 and 7 however, the batteries and electronic circuits are housed at the end of the lock body 10 opposite the barrel 11 within an enlarged hollow knob 60 which is used instead of the knob 30 of FIG. 1. Except for the knob 60 and the parts contained in it, the lock shown in FIGS. 6 and 7 is identical to that shown in FIGS. 1 to 5 and will not be described.

The end of the body carrying the knob 60 is shaped to provide bearings for the knob, which rotates about an axis aligned with the longitudinal median line of the body rather with the axis of the bore as in FIG. 1. The knob 60 is in the form of a cup and a drive gear 60$^a$ is provided inside this cup, which, in the example shown, is an internal ring gear. The gear 60$^a$ meshes with a gear 131$^a$ on a shaft 131$^b$ on the part 131 which has exactly the same form and function as the boss 31 on the knob 30 in the embodiment shown in FIG. 1.

The part of the lock body within the knob 60, which is removable, is shaped to support two standard cylindrical batteries 61, 62 and a printed circuit board 63 or the like carry the electronic circuits of the lock.

The batteries and electronics are housed in a very convenient position on a lock body which is otherwise of standard shape and configuration. No special additional mortice hole or lock escutcheon is required to house these parts.

It will be noted from FIG. 6, which shows the lock with a key in position, that additional displacement of the plunger 32 to the left as view in FIG. 6 is possible. This additional displacement occurs if the key is inserted into the barrel when the knob/plunger/cam drive member/output cam assembly are, for any reason, out of their normal rest positions so that the slot in the plunger 32 is not aligned with the keyslot in the barrel 11. The end of the key then abuts the end of the plunger and, on full insertion, the key drives the plunger further to the left. In this condition, the lock electronics is still energised so that if the key is recognised the barrel becomes rotatable. There is, however, no driving connection between the key and the plunger 32 until the key is turned to align the key slot with the slot in plunger 32. The plunger 32 can then move to the right so that the key provides the required driving connection.

The embodiments described above are both locks in which the cylinder body extends through an opening in the lock casing (mounted in a mortice hole in a door) so that opposite ends of the cylinder body are accessible from opposite sides of the door. However, various aspects of the invention are applicable to other types of cylinder lock. One conventional type of cylinder lock is single ended, i.e. the cylinder body is mounted in a bore in the outside of the door and the barrel is coupled to a rim-type lock mounted on the inside of the door by a coupling rod. With this type of lock, the electromagnetic detent arrangement used in the embodiments described could be employed in exactly the same manner, but some other means of housing a battery and detecting key insertion would be used.

Similarly the electromagnetic detent arrangement could be used in a cylinder for a US-style mortice lock in which the cylinder body is of circular cross-section and is attached to the lock casing by interengaged screw threads. In this case, the batteries could be housed in a dummy cylinder body fitted to the other side of the lock casing with a knob/drive arrangement like that shown in FIGS. 6 and 7, but wiring would be required to connect the batteries to the electromagnet detent arrangement.

The electromagnetic detent arrangement could also be applied to a lock of the type in which the cylinder body is integral with the lock casing.

The embodiments shown may be modified in the case where the cylinder body is full-length, to put the electromagnet detent arrangement at the end of the cylinder body opposite that which has the normal key-receiving barrel therein. The detent arrangement would coact with a slot/cam formation in an auxiliary barrel coupled to the key barrel. Such a construction would give good protection against rapping and would also make it more difficult for a burglar to seize up the detent arrangement by squirting a sticky or settable liquid into the cylinder.

Figure 9:
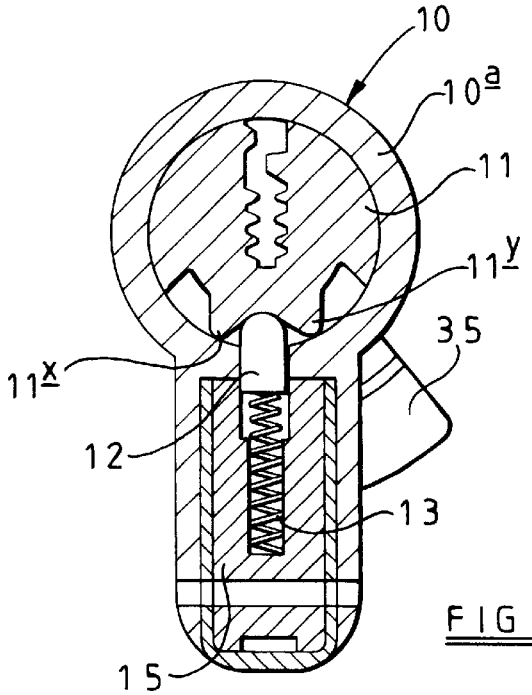
FIG. 9 is a cross-sectional view like FIG. 2 but showing a modification

FIG. 9 shows a possible modification to the cam formation used to move the bar 12 between detent and release positions. Now, instead of a single centrally placed projection 11$^e$, there are two such projections 11$^x$ and 11$^y$ symmetrically arranged about the centre of the slot formation. In the normal rest position shown, the ends of the bar rest between these projections so that the bar is at (or close to) its detent position. Turning the barrel in either direction brings the bar to its release position so that a small current in the electromagnet winding will still suffice to hold the bar in its release position. With this arrangement the locating pin 19 can be omitted.

Figure 8:
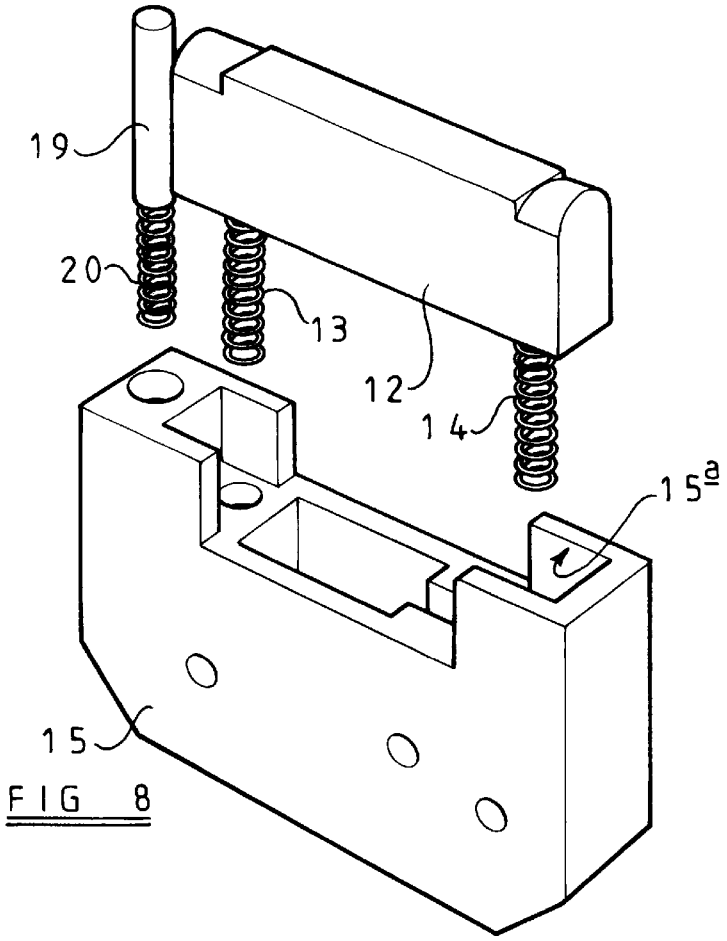
FIG. 8 is an exploded perspective view showing the bar and electromagnet carrier used in the example shown in FIGS. 1 to 4.

FIG. 8 shows in more detail the relationship between the locking bar 12 and the carrier 15 for the electromagnet. The electromagnet itself is omitted for clarity. It will be noted that the carrier 15 has a recess 15$^a$ in the face thereof which is directed in use towards the barrel. This recess 15$^a$ is aligned with a slot in the body and the recess provides accurate location of the bar 12 when the sub-assembly of bar, springs, carrier and electromagnet is inserted into the cylinder body.

It should be noted that the bar 12 shown in FIG. 8 is modified somewhat as compared with that shown in FIGS.

1 to 4. In the first embodiment, the surfaces of the bar which coact with the cam formations $11^e$ on the barrel are flush with the inner face of the bar, but those shown in FIG. 8 are slightly proud of the inner face of the bar so that the bar can be displaced radially outwardly by the cam portions $11^e$ slightly further than is strictly necessary to raise the face of the bar clear of the barrel. This enables the tolerances on the dimensions of the bar, carrier and barrel to be somewhat relaxed. To ensure that the gap between the electromagnet core and the bar is completely closed in use, the electromagnet is left free to be moved radially in the carrier 15, being retained by a pin $16^a$ (FIG. 1) through an elongated slot in the magnet core. The core is urged towards the barrel by a resilient element $16^b$ such as a leaf spring or a piece of rubber or elastomeric material in the base of the recess in the carrier 15 which receives the electromagnet.

With this arrangement, the resilient device urges the electromagnet 16 into contact with the locking bar 15 which is itself held in contact with the cam portions $11^e$ when the lock parts are in their normal rest positions. The bar 15 is well clear of the barrel so that the barrel can be turned.

Figure 10:
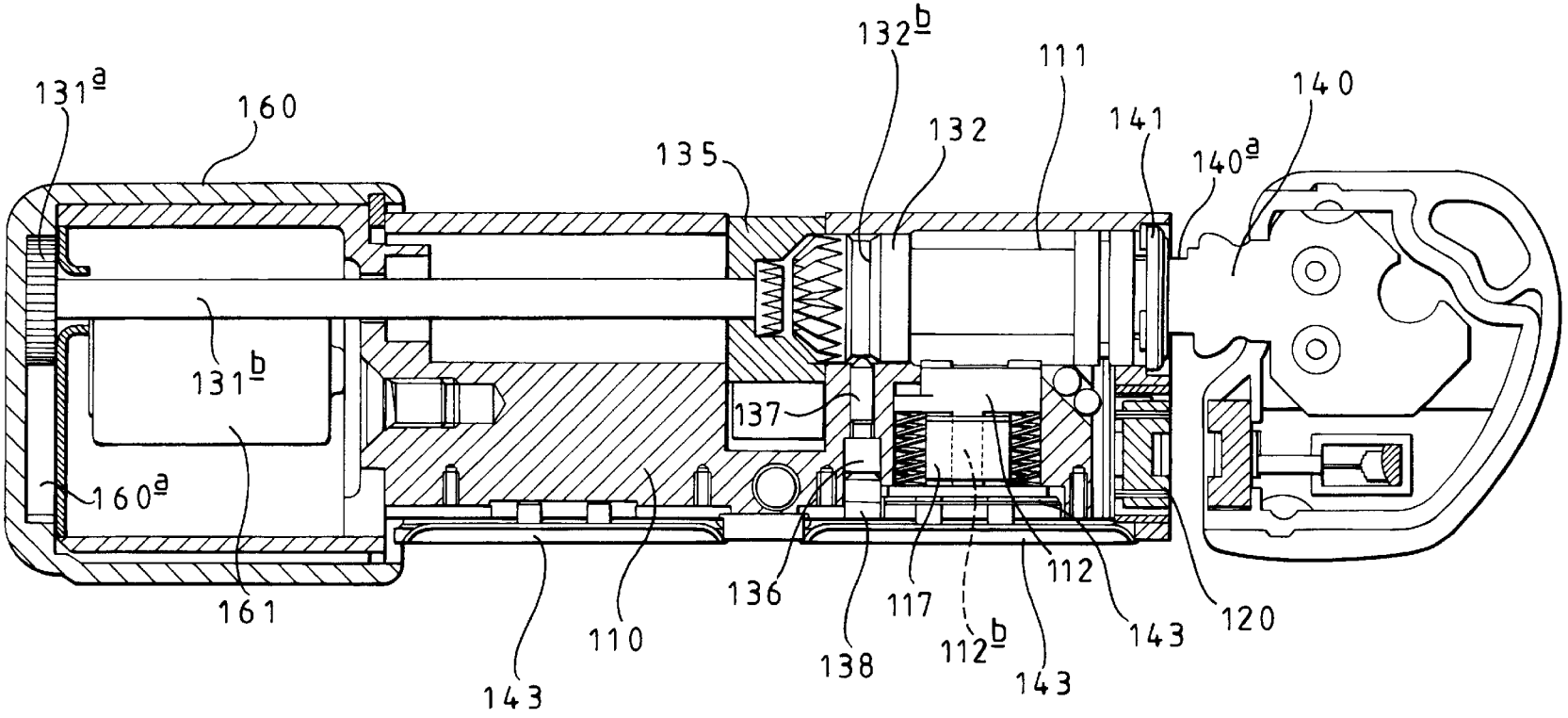
FIG. 10 is a longitudinal section showing a third embodiment of the invention.
Figure 11:
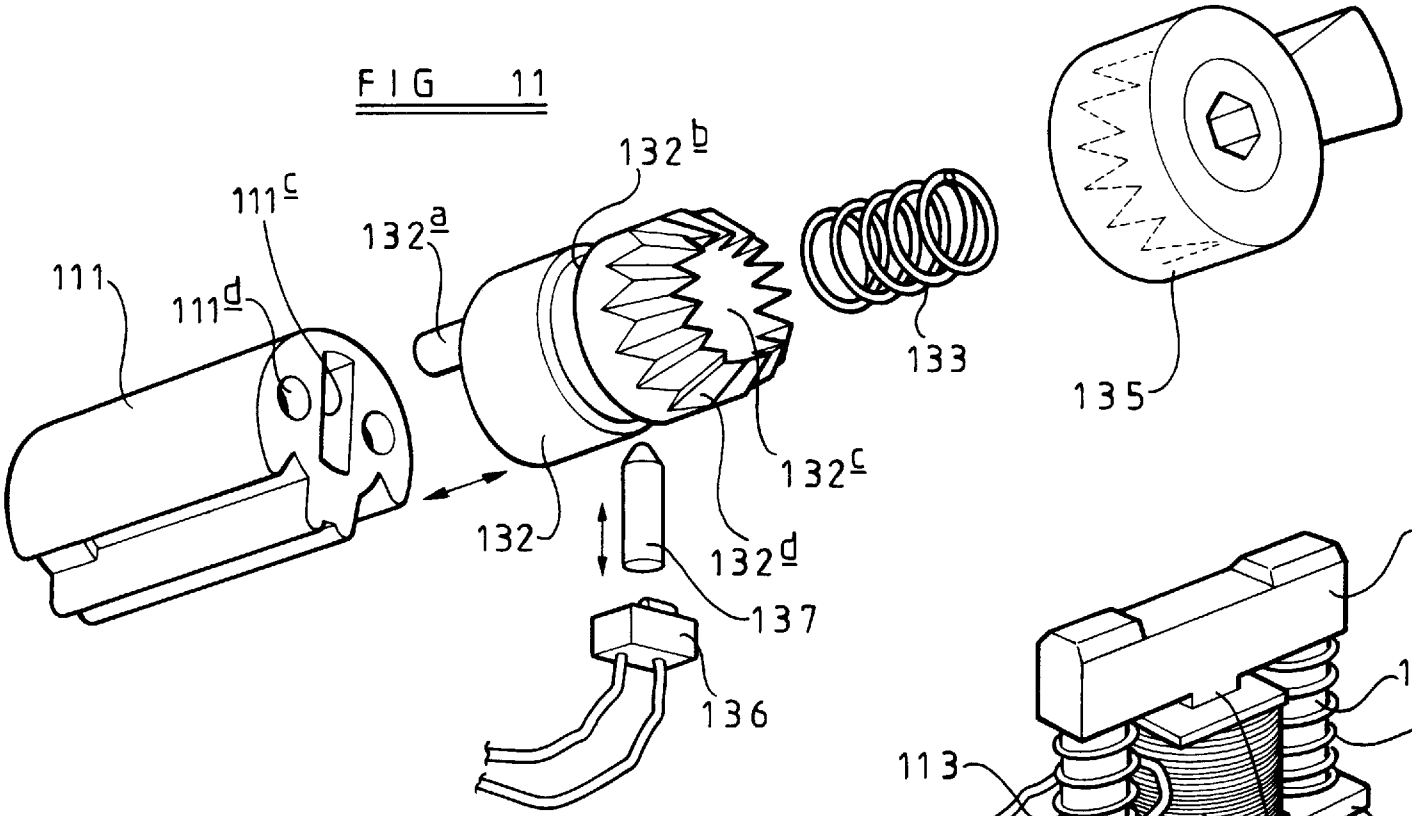
FIG. 11 is an exploded perspective view showing parts of the third embodiment.
Figure 12:
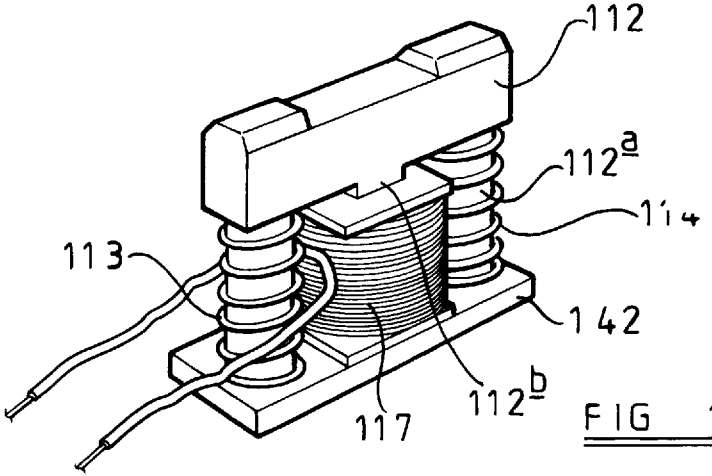
FIG. 12 is a perspective view of a locking bar and electromagnet forming part of the third embodiment.

FIGS. 10 to 12 show a third embodiment of the invention. Parts corresponding to those shown in FIG. 6 are given the same reference numerals increased by 100.

In this third embodiment, the barrel 111 has a substantially constant cross-section throughout its axial length, such section being substantially the same as that shown in FIG. 9. The keyslot $111^c$ is a plain rectangular slot instead of being shaped to receive a profiled key.

The plunger 132 has, at one end, two projecting pins $132^a$ which may be either integral parts of the plunger or separate parts attached thereto. These pins are slidably received by axial bores $111^d$ in the end of the barrel. The plunger 132 is of generally cylindrical shape and it is rotatable and axially movable in the bore in the body. It has a groove $132^b$ in its external surface which coacts with a radially slidable pin 137 having a conical end. The pin 137 is mounted in a radial bore in the body 110 and coacts with a miniature microswitch 136 held in place by a plug 138 in the outer end of this radial bore.

The end face of the plunger 132 from which the pins $132^a$ project has a slot $132^b$ (FIG. 10) to receive the end of the key blade. The opposite end of the plunger 132 has a blind axial bore $132^c$ and is formed with tapering drive teeth $132^d$ on a generally frusto conical end surface.

This opposite end of the plunger 132 is received in a recess in the output cam 135 which has a matching internal conically arranged drive tooth arrangement. A spring 133 is fitted inside the blind bore $132^c$ and urges the plunger towards the barrel 111.

As shown in FIG. 10, the key blade 140 is formed with a notch $140^a$ which coacts with a notched plate 141 in the mouth of the main bore in the body so as to provide a well-known interlocking arrangement to prevent the key being turned until the blade is fully inserted and also to prevent the key; once inserted and turned, from being withdrawn unless the barrel is in its proper rest position. In the position shown in FIG. 10, the key is not yet fully inserted but its end has entered the slot provided in the end face of the plunger 132 which is pressed against the end of the barrel by the spring 133. In this position of the plunger 132 the tooth formations on its end are not interengaged with those in the recess in the cam 135. The end of the pin 137 is in the groove $132^b$. As the key is pushed home, the plunger 132 is moved to the left as viewed in FIG. 10, causing the pin 137 to be displaced radially outwardly to actuate the switch 136 and the tooth formations to become interengaged to provide a driving connection between the barrel 111 and the cam 135.

The locking bar/electromagnet arrangement used in this third embodiment is shown in FIG. 12. The locking bar 112 is of generally E-shaped form, having two circular section limbs $112^a$ at the ends and a square-section limb $112^b$ at the centre. The central square-section limb $112^b$ extends into a square-section passageway in the solenoid 117 which is mounted on a base plate 142. As shown in FIG. 10, the locking bar/electromagnet arrangement is fitted into a chamber in the body, with a base plate 142 seated on a yieldable resilient cushion so that the whole electromagnet can be displaced radially by the bar as described above in connection with FIG. 8.

Wiring between the detector solenoid 120, the electromagnet, the switch and the electronic circuit within the knob 160 is arranged in a groove running axially along the outside of the body 110, which is closed off by a push in cover 143, which may be in one piece or two or more separate pieces.

It is claimed:

1. A lock device comprising a body having a bore with a direction of elongation defining an axial direction for the device, a rotatable barrel in said bore, said barrel being provided with an axially extending locking slot formation, an axially extending bar slidably mounted in the body for radial movement relative to the barrel between a detent position in which the bar projects into the locking slot formation to limit turning of the barrel and a release position in which the bar is clear of said locking slot formation, a cam formation on said barrel for displacing the bar from its detent position to its release position as the barrel is turned in the body and an electromagnet energisable to retain said bar by magnetic attraction in its release position.

2. A lock device as claimed in claim 1 in which said cam formation on said barrel comprises two spaced cam portions at opposite ends of the locking slot, acting on portions of the bar at opposite ends thereof.

3. A lock device as claimed in claim 1 in which the cross-section of the cam formation is substantially constant along the active length of the slot, the locking bar having spaced cam-engaging portions at opposite axial ends thereof.

4. A lock device as claimed in claim 2 in which the locking bar is urged towards the barrel by two independent springs acting on opposite ends of the bar.

5. A lock device as claimed in claim 4 in which the locking bar is of an E-shaped configuration.

6. A lock device as claimed in claim 1 in which the cam formation on the barrel has a twin peak profile such that in a normal rest position, the bar is in its detent position, but is displaced to its release position by initial turning of the barrel out of said normal rest position.

7. A lock device as claimed in claim 1 in which the electromagnet is mounted in the body so as to be movable radially relative to the barrel and the cam formation on the barrel is dimensioned so as to ensure that the bar makes actual physical contact with the electromagnet and displaces the electromagnet radially outwardly as the bar is moved to its release position.

8. A lock device as claimed in claim 7, in which a resilient cushion is arranged in the body to be compressed by outward movement of the electromagnet.

9. A lock device as claimed in claim 3 in which the locking bar is urged towards the barrel by two independent springs acting on opposite ends of the bar.

10. A lock device as claimed in claim 2 in which the locking bar is of an E-shaped configuration.

11. A lock device as claimed in claim 3 in which the locking bar is of an E-shaped configuration.

* * * * *